US005947594A

United States Patent [19]

Dolatli et al.

[11] Patent Number: 5,947,594

[45] Date of Patent: Sep. 7, 1999

[54] AGITATOR DEVICE WITH VIBRATING CLAMPING MEMBER

[76] Inventors: George Dolatli, 11613 Woodley Ave., Granada Hills, Calif. 91344; Paulino Rivas, 7968 Mammoth Ave., Panorama City, Calif. 91402

[21] Appl. No.: 09/044,314

[22] Filed: Mar. 19, 1998

[51] Int. Cl.[6] ..... B01F 11/00

[52] U.S. Cl. ..... 366/110; 366/128; 366/209

[58] Field of Search ..... 366/110–112, 114, 366/128, 208–216, 219; 74/87

[56] References Cited

U.S. PATENT DOCUMENTS

| | | | |
|---|---|---|---|
| 392,865 | 11/1888 | Kanable | 366/110 |
| 2,247,978 | 7/1941 | Van Arkel | 366/110 |
| 3,061,280 | 10/1962 | Kraft et al. | 366/110 |
| 4,135,826 | 1/1979 | Holm | 366/128 |
| 5,642,938 | 7/1997 | Nagagawa et al. | 366/110 |
| 5,798,588 | 8/1998 | Okuyama et al. | 74/87 |

*Primary Examiner*—Charles E. Cooley

[57] ABSTRACT

A new agitator device for producing a vibration to agitate a dialyzer device, that is an artificial kidney device to help the movement of air, blood, and stelizant flowing through the dialyzer. The inventive device includes a housing with an inner surface defining a hollow interior. A support clamp designed for attachment to a support is extended from the distal end of the housing. A C-shaped clamping member is extended from the proximal end of the housing. The C-shaped clamping member has a pair of arms each having a terminal end. The arms of the clamping member are spaced apart to define a clamping space therebetween for holding an object. A vibrating device is provided within the hollow interior of the housing and is designed for vibrating the housing.

8 Claims, 2 Drawing Sheets

AGITATOR DEVICE WITH VIBRATING CLAMPING MEMBER

BACKGROUND OF THE INVENTION

1. Field of the Invention

The present invention relates to devices for artificial kidney machines and more particularly pertains to a new agitator device for producing a vibration to agitate a dialyzer device, that is an artificial kidney device to help the movement of air, blood, and stelizant flowing through the dialyzer.

2. Description of the Prior Art

The use of devices for artificial kidney machines is known in the prior art. More specifically, devices for artificial kidney machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for artificial kidney machines include U.S. Pat. No. 5,322,253; U.S. Pat. No. 4,666,111; U.S. Pat. No. 5,386,728; U.S. Pat. No. 3,877,288; U.S. Pat. No. 4,844,397; and U.S. Pat. No. Des. 286,978.

While these devices fulfill their respective, particular objectives and requirements, the aforementioned patents do not disclose a new agitator device. The inventive device includes a housing with an inner surface defining a hollow interior. A support clamp designed for attachment to a support is extended from the distal end of the housing. A C-shaped clamping member is extended from the proximal end of the housing. The C-shaped clamping member has a pair of arms each having a terminal end. The arms of the clamping member are spaced apart to define a clamping space therebetween for holding an object. A vibrating device is provided within the hollow interior of the housing and is designed for vibrating the housing.

In these respects, the agitator device according to the present invention substantially departs from the conventional concepts and designs of the prior art, and in so doing provides an apparatus primarily developed for the purpose of producing a vibration to agitate a dialyzer device, that is an artificial kidney device to help the movement of air, blood, and stelizant flowing through the dialyzer.

SUMMARY OF THE INVENTION

In view of the foregoing disadvantages inherent in the known types of devices for artificial kidney machines now present in the prior art, the present invention provides a new agitator device construction wherein the same can be utilized for producing a vibration to agitate a dialyzer device, that is an artificial kidney device to help the movement of air, blood, and stelizant flowing through the dialyzer.

The general purpose of the present invention, which will be described subsequently in greater detail, is to provide a new agitator device apparatus and method which has many of the advantages of the devices for artificial kidney machines mentioned heretofore and many novel features that result in a new agitator device which is not anticipated, rendered obvious, suggested, or even implied by any of the prior art devices for artificial kidney machines, either alone or in any combination thereof.

To attain this, the present invention generally comprises a housing with an inner surface defining a hollow interior. A support clamp designed for attachment to a support is extended from the distal end of the housing. A C-shaped clamping member is extended from the proximal end of the housing. The C-shaped clamping member has a pair of arms each having a terminal end. The arms of the clamping member are spaced apart to define a clamping space therebetween for holding an object. A vibrating device is provided within the hollow interior of the housing and is designed for vibrating the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new agitator device apparatus and method which has many of the advantages of the devices for artificial kidney machines mentioned heretofore and many novel features that result in a new agitator device which is not anticipated, rendered obvious, suggested, or even implied by any of the prior art devices for artificial kidney machines, either alone or in any combination thereof.

It is another object of the present invention to provide a new agitator device which may be easily and efficiently manufactured and marketed.

It is a further object of the present invention to provide a new agitator device which is of a durable and reliable construction.

An even further object of the present invention is to provide a new agitator device which is susceptible of a low cost of manufacture with regard to both materials and labor, and which accordingly is then susceptible of low prices of sale to the consuming public, thereby making such agitator device economically available to the buying public.

Still yet another object of the present invention is to provide a new agitator device which provides in the apparatuses and methods of the prior art some of the advantages thereof, while simultaneously overcoming some of the disadvantages normally associated therewith.

Still another object of the present invention is to provide a new agitator device for producing a vibration to agitate a dialyzer device, that is an artificial kidney device to help the movement of air, blood, and stelizant flowing through the dialyzer.

Yet another object of the present invention is to provide a new agitator device which includes a housing with an inner surface defining a hollow interior. A support clamp designed for attachment to a support is extended from the distal end of the housing. A C-shaped clamping member is extended from the proximal end of the housing. The C-shaped clamping member has a pair of arms each having a terminal end. The arms of the clamping member are spaced apart to define a clamping space therebetween for holding an object. A vibrating device is provided within the hollow interior of the housing and is designed for vibrating the housing.

Still yet another object of the present invention is to provide a new agitator device that allows a more complete draining of accumulated blood through the compartments of the dialyzer system. This helps to minimize the blood lost by a patient on the dialyzer.

Even still another object of the present invention is to provide a new agitator device that helps to remove stelizant from the fibers of the dialyzer to help minimize the time spent waiting for the priming procedure before the dialysis can begin.

Even still yet another object of the present invention is to provide a new agitator device that helps increase the life of use for the dialyzer by helping minimize the risk of blood clotting in the blood compartment fibers of the dialyzer due to residual blood remaining in the dialyzer unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
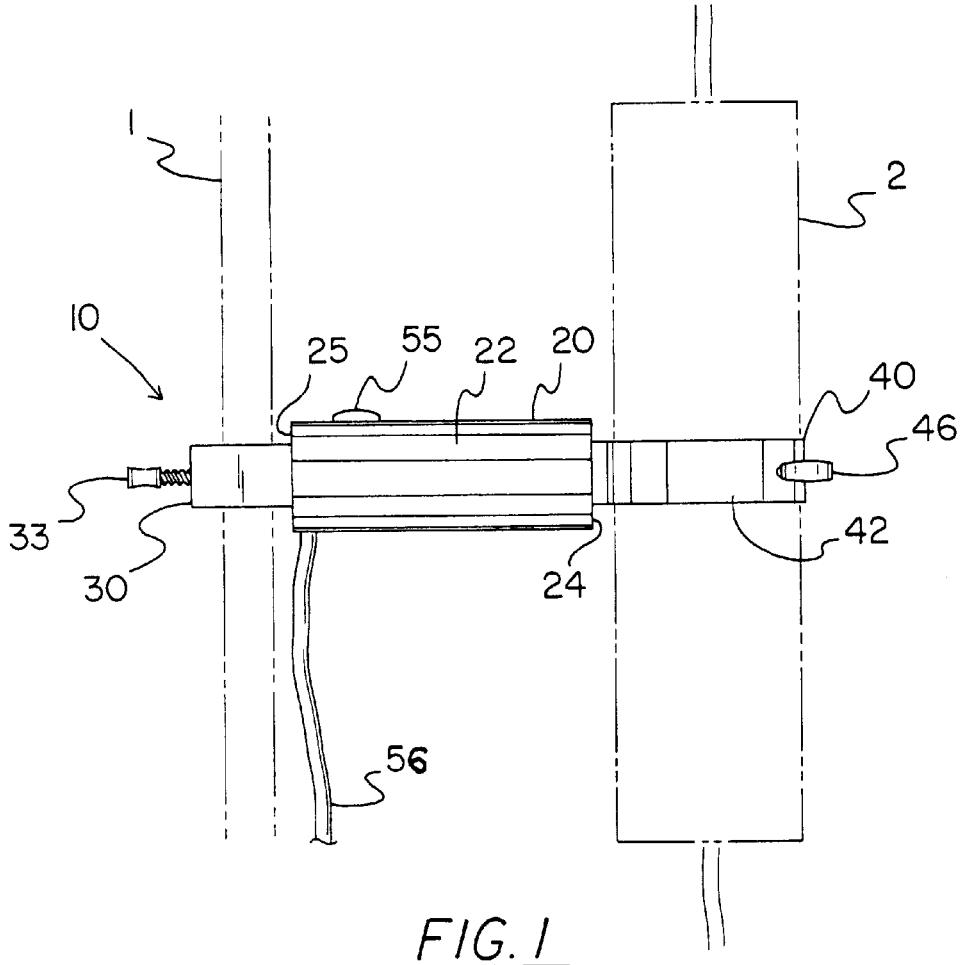
FIG. 1 is a schematic side view of a new agitator device in use attached to a support and a dialyzer according to the present invention.

With reference now to the drawings, and in particular to FIGS. 1 through 4 thereof, a new agitator device embodying the principles and concepts of the present invention and generally designated by the reference numeral 10 will be described.

As best illustrated in FIGS. 1 through 4, the agitator device 10 generally comprises a housing 20 with an inner surface 21 defining a hollow interior. A support clamp 30 designed for attachment to a support 1 is extended from the distal end 25 of the housing 20. A C-shaped clamping member 40 is extended from the proximal end 24 of the housing 20. The C-shaped clamping member 40 has a pair of arms 41,42 each having a terminal end 43,44. The arms 41,42 of the clamping member 40 are spaced apart to define a clamping space therebetween for holding an object 2. A vibrating device 50 is provided within the hollow interior of the housing 20 and is designed for vibrating the housing 20.

In closer detail, the housing 20 has inner and outer surfaces 21,22 with the inner surface 21 defining the hollow interior of the housing 20. The housing 20 is preferably cylindrical in shape and has opposite proximal and distal ends 24,25.

Figure 2:
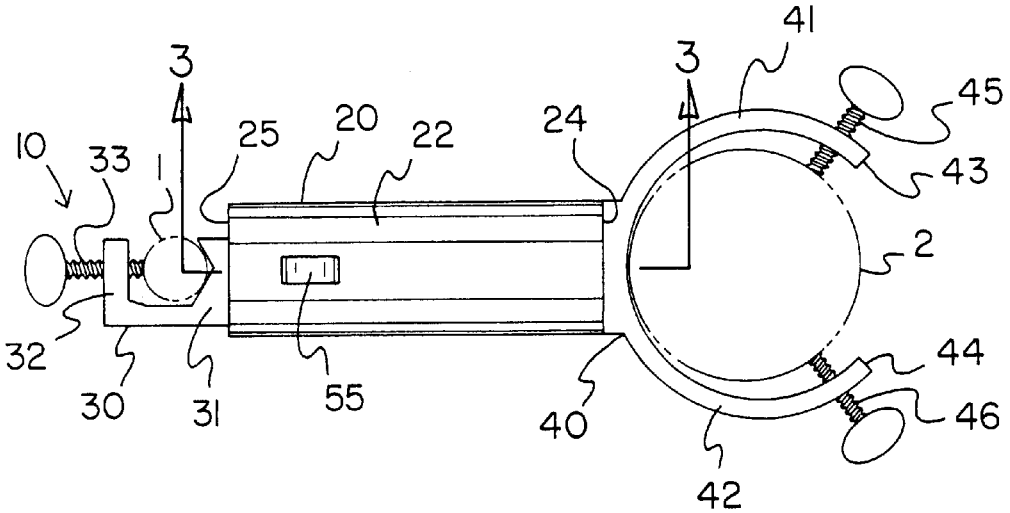
FIG. 2 is a schematic top side view of the present invention.

Extending from the distal end 25 of the housing 20 is the support clamp 30. The support clamp 30 is designed for attachment to a support 1, such as a vertical elongate pole like a intravenous bag hanger. As shown in FIG. 2, the support clamp 30 has a base 31 and a clamping flange 32 with the base 31 positioned adjacent to the distal end 25 of the housing 20. The clamping flange 32 is spaced apart from the base 31 define a space between them for receiving a support 1 within the space. Preferably, the clamping flange 32 has a threaded clamping rod 33 extending through it for helping hold a support object I disposed within the space to the support clamp 30.

With reference to FIG. 2, the C-shaped clamping member 40 extends from the proximal end 24 of the housing 20. The clamping member 40 is designed for holding an object 2, such as a dialyzer, to the housing 20. The clamping member 40 has a pair of opposing arms 41,42 each terminating at a terminal end 43,44. The arms 41,42 of the clamping member 40 are spaced apart to define a clamping space therebetween for receiving an object 2, such as a dialyzer, therein. Each of the arms 41,42 has a threaded clamping rod 45,46 extending therethrough for holding the object 2 disposed within the clamping space to the clamping member 40. Preferably, each of the clamping rods 45,46 is positioned towards the terminal end 43,44 of its respective the arm 41,42. Ideally, the clamping rods 45,46 comprise quick-release pins.

Figure 3:
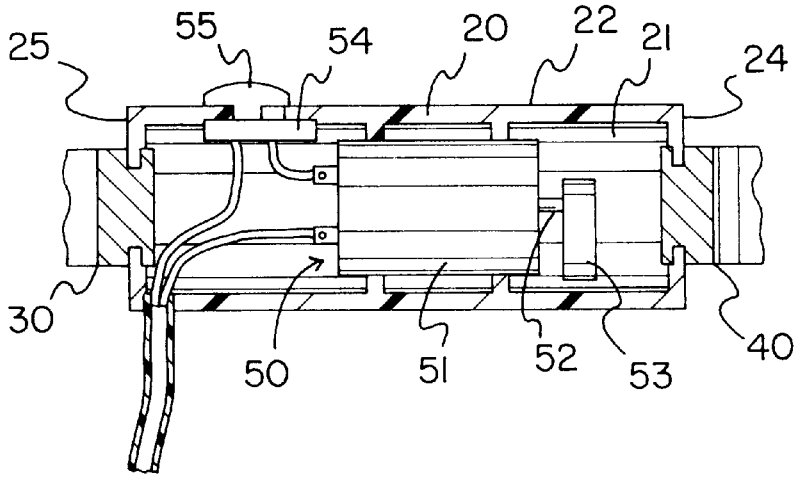
FIG. 3 is a schematic partial cross-sectional view of the present invention taken from line 3—3 on FIG. 2.
Figure 4:
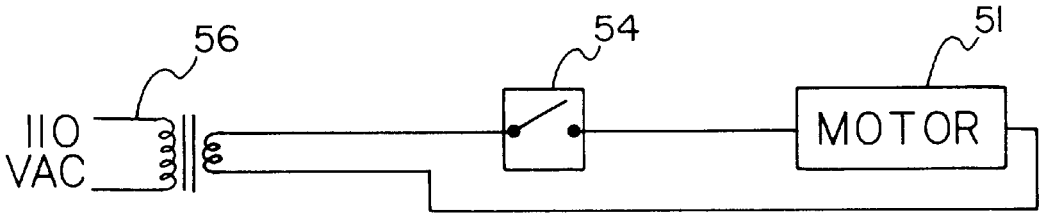
FIG. 4 is an electrical schematic of the vibrating device of the present invention.

As illustrated in FIG. 3, the vibrating device 50 is provided within the hollow interior of the housing 20. The vibrating device 50 is designed for vibrating the housing 20 so that an object held by the clamping member 50 is agitated. The vibrating device includes a motor 51 with a rotating shaft 52 disposed within the hollow interior of the housing 20. The motor 51 rotates the rotating shaft 52 when powered. Preferably, the motor 51 is mounted to the housing 20 to help hold the motor in place when rotating. The vibrating device 50 also includes an eccentric member 53 coupled to the rotating shaft 52 for vibrating the housing 20 when rotated. The rotating shaft 52 provides the eccentric motion of the eccentric member 53 when rotated.

Preferably, the vibrating device also includes a switch 54 electrically coupled to the motor 51 for permitting selective powering of the motor 51. The switch also preferably has an actuator 55 provided on the outer surface 22 of the housing 20 for permitting selective operation of the switch 54. A power source 56 is electrically coupled by an electric wire cord to the motor 51 to provide power to the motor 51.

In use, the agitator device is designed for vibrating a hemodialysis system having a dialyzer for providing dialysis to a patient. The agitator device 10 is designed for positioning between a support 1, such as the support pole of an intravenous bag holder, and an object 2, such as a dialyzer device. The device 10 is held to the support 1 by the support clamp 30 and its other end is attached to the dialyzer 2 with the clamping member 40. When the motor 51 is powered, the eccentric member 53 is rotated in an eccentric motion by and about the rotating shaft 52. This causes the housing 20 to vibrate thereby vibrating the object 2 held by the clamping member 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An agitator device for positioning between a support and a dialyzer device, said agitator device comprising:

a housing having inner and outer surfaces, and opposite proximal and distal ends, said inner surface of said housing defining a hollow interior;

a support clamp coupled to and extended from said distal end of said housing, said support clamp being for attachment to a support;

a C-shaped clamping member, said C-shaped clamping member having a pair of arms, each of said arms of said clamping member having a terminal end, said arms of said clamping member coupled to said proximal end of said housing and spaced apart to define a clamping space therebetween; and a vibrating device being provided within said hollow interior of said housing, said vibrating device being for vibrating said housing;

wherein each of said arms of said clamping member has a threaded clamping rod being extended therethrough for holding an object disposed within said clamping space to said clamping member.

2. The agitator device of claim 1, wherein said vibrating device includes:

a motor having a rotating shaft, said motor rotating said rotating shaft of said motor when powered; and an eccentric member being coupled to said rotating shaft of said motor, said rotating shaft providing eccentric motion of said eccentric member when rotated, said eccentric member vibrating said housing when rotated.

3. The agitator device of claim 2, wherein said vibrating device further includes a switch being electrically coupled to said motor, and a power source being electrically coupled to said motor.

4. The agitator device of claim 3, wherein said switch has an actuator being provided on said outer surface of said housing, said actuator being for selective operation of said switch.

5. The agitator device of claim 1, wherein said support clamp has a base and a clamping flange, said base of said support clamp being positioned adjacent to said distal end of said housing, said clamping flange of said support clamp being spaced apart from said base of said support clamp to define a space therebetween.

6. The agitator device of claim 5, wherein said clamping flange of said support clamp has a threaded clamping rod being extended therethrough for holding an object disposed within said space of said support clamp to said support clamp.

7. The agitator device of claim 1, wherein each of said threaded clamping rods is positioned towards said terminal end of its respective said arm of said clamping member.

8. An agitator device for positioning between a support and a dialyzer device, said agitator device comprising:

a housing having inner and outer surfaces, and opposite proximal and distal ends, said inner surface of said housing defining a hollow interior;

a support clamp coupled to and extended from said distal end of said housing, said support clamp being for attachment to a support, said support clamp having a base and a clamping flange, said base of said support clamp being positioned adjacent to said distal end of said housing, said clamping flange of said support clamp being spaced apart from said base of said support clamp to define a space therebetween, said clamping flange of said support clamp having a threaded clamping rod being extended therethrough for holding an object disposed within said space of said support clamp to said support clamp;

a C-shaped clamping member, said C-shaped clamping member having a pair of arms, each of said arms of said clamping member having a terminal end, said arms of said clamping member coupled to said proximal end of said housing and spaced apart to define a clamping space therebetween, each of said arms having a threaded clamping rod being extended therethrough for holding an object disposed within said clamping space to said clamping member, each of said threaded clamping rods being positioned towards said terminal end of its respective said arm of said clamping member; and a vibrating device being provided within said hollow interior of said housing, said vibrating device being for vibrating said housing;

said vibrating device including:

a motor having a rotating shaft, said motor rotating said rotating shaft of said motor when powered;

an eccentric member being coupled to said rotating shaft of said motor, said rotating shaft providing eccentric motion of said eccentric member when rotated;

a switch having an actuator, said switch being electrically coupled to said motor, said actuator being provided on said outer surface of said housing; and a power source being electrically coupled to said motor.

* * * * *